United States Patent [19]

Sussman et al.

[11] Patent Number: 4,937,043

[45] Date of Patent: Jun. 26, 1990

[54] BORON ALLOY

[75] Inventors: Richard C. Sussman, West Chester; Larry G. Evans, Middletown, both of Ohio

[73] Assignee: Armco Inc., Middletown, Ohio

[21] Appl. No.: 945,197

[22] Filed: Dec. 19, 1986

Related U.S. Application Data

[60] Continuation of Ser. No. 784,242, Oct. 4, 1985, abandoned, which is a division of Ser. No. 576,341, Feb. 2, 1984, Pat. No. 4,572,747.

[51] Int. Cl.[5] ..... C22C 33/00; C22C 19/05

[52] U.S. Cl. ..... 420/121; 420/117; 420/441

[58] Field of Search ..... 148/403; 420/441, 121, 420/117; 75/123 B

[56] References Cited

U.S. PATENT DOCUMENTS

| | | | |
|---|---|---|---|
| 4,036,638 | 7/1977 | Ray et al. | 75/123 B |
| 4,133,679 | 1/1979 | Ray | 75/123 B |
| 4,217,135 | 8/1980 | Luborsky et al. | 75/123 L |
| 4,300,950 | 11/1981 | Luborsky et al. | 75/123 B |
| 4,302,515 | 11/1981 | DeCristofaro | 428/680 |
| 4,338,131 | 7/1982 | Briggs, Jr. | 148/403 |
| 4,359,352 | 11/1982 | Ray et al. | 148/31 |
| 4,505,745 | 3/1985 | Hamada et al. | 75/129 |
| 4,624,716 | 11/1986 | Noel et al. | 148/127 N |

FOREIGN PATENT DOCUMENTS

| | | | |
|---|---|---|---|
| 2915737 | 11/1979 | Fed. Rep. of Germany | 420/121 |
| 91157 | 5/1983 | Japan . | |
| 77919 | 11/1983 | Japan . | |

OTHER PUBLICATIONS

Digges et al. Effect of Boron on the Hardenability of High Purity Alloys and Commercial Steels J Research of NBS vol. 41, Dec. 1948.

Rosenfelder W. J. "Industrial Developments of Amorphous Metal" Chemistry & Industry, Aug. 15, 1983, pp. 639–641.

*Primary Examiner*—Deborah Yee

*Attorney, Agent, or Firm*—Frost & Jacobs

[57] ABSTRACT

A process for making a boron alloy from a ferrous or non-ferrous melt by adding a boron compound to the melt and reducing the compound within the melt by a reductant, such as aluminum, silicon or carbon, such that the boron can alloy with the melt. A boron alloy containing from very little boron up to 15% boron by weight can be formed. At least 40% of the boron compound is reduced to boron.

The alloy can also be employed to make an amorphous material by discharging the molten alloy onto a moving surface to form a strip. The moving surface is a chill body which can quench the strip at a rate of at least from $10^4$ ° C./sec, or higher to solidify the strip and form an amorphous boron alloy material.

11 Claims, 3 Drawing Sheets

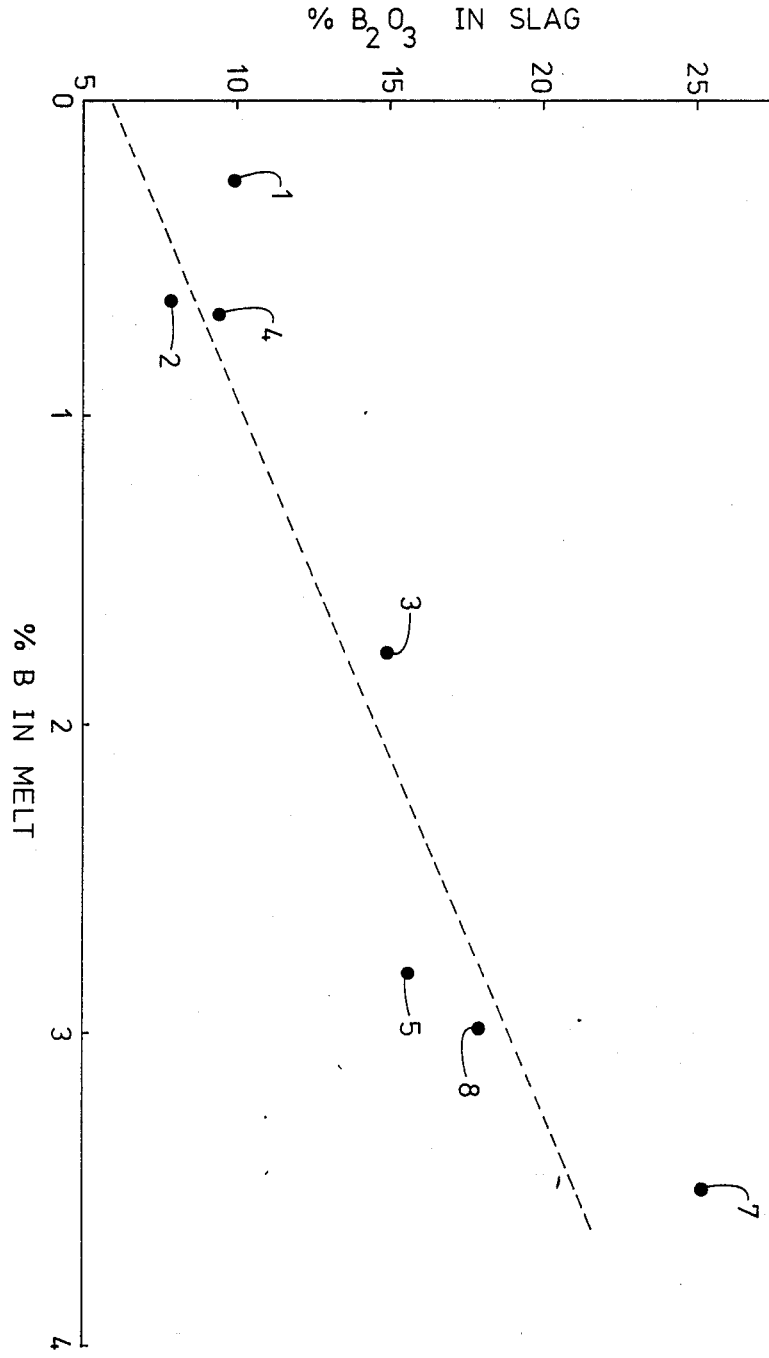
% $B_2O_3$ IN SLAG
30
25
20
15
10
5
0
1
2
3
4
% B IN MELT
1
2
3
4
5
7
8

BORON ALLOY

This is a continuation of application Ser. No. 784,242, filed Oct. 4, 1985, now abandoned, which is a division of application Ser. No. 576,341, filed Feb. 2, 1984, now U.S. Pat. No. 4,572,747.

BACKGROUND OF THE INVENTION

1. Field of the Invention

The present invention relates to a method of producing boron alloy with a boron content between about 0.001% and 15% by weight and a product produced by the method. Although not so limited, the method of this invention has particular utility in the production of both crystalline and amorphous boron alloys by in situ reduction of a boron compound in a metallic melt.

2. Description of the Prior Art.

Boron is a metalloid and exhibits properties of both metals and non-metals. Consequently, when boron is employed in an alloy composition, the alloy can be further treated to have properties of metals and/or non-metals.

A ferro-boron alloy melt maintains the crystalline structure of iron upon solidification. Boron employed in the alloy will increase strength, hardenability, toughness, drawability, thermal stability and enamelability. Crystalline boron alloys are employed to make, for example, wire or tools.

A ferro-boron alloy melt containing greater than 1.4% by weight boron can be further treated to form a solid amorphous structure. These amorphous alloys are being investigated for use in electrical applications because it has been found that amorphous ferro-boron alloys have lower core loss than conventional silicon steel employed for the same purpose. For example, an amorphous ferro-boron alloy containing iron, silicon, boron and carbon may have potential application for making transformers or high frequency switching cores.

Because some non-ferrous alloys can be further treated to yield an amorphous material irrespective of the amount of boron, no significant comparison can be made between the ferro-boron alloys and the non-ferrous boron alloys.

A crystalline non-ferrous boron alloy, for example, an alloy containing primarily boron, manganese, chromium, nickel, and cobalt can be used for die-casting a case or strap for a watch.

On the other hand, a non-ferrous boron alloy containing, for example, a nickel base aluminum alloy can be further treated to form an amorphous material which can be used to make razor blades or metallic belts for automobile tires.

Boron occurs in many forms such as, for example, boron oxide, boric acid, sodium tetraborate (borax), calcium metaborate, colemanite, rasorite, ulexite, probertite, inderite, kernite, kurnakovite and sassolite. These impure compounds are processed to nearly pure boron by mineral processing companies. The boron oxide is converted to an iron-boron alloy containing typically 18% boron by special reduction processes. The processed iron-boron alloy is sold to foundries and steel plants, as an additive for a ferrous melt as is disclosed in the following patents:

U.S. Pat. No. 1,562,042 teaches the conventional ferro-boron additive which is later added to the melt steel. The additive contains approximately 18% boron with the remainder being predominantly iron and a small amount of aluminum. The additive is made by mixing boron oxide, aluminum, and ferric oxide into a briquette and igniting the briquette such that an alumino-thermic reaction occurs, forming the ferro-boron additive. The additive is shipped to various steel mills or foundries to supplement the melt steel in amounts such that approximately up to ¾ of a percent by weight of boron is alloyed with the final steel.

U.S. Pat. No. 2,616,797 also employs a thermite reaction for producing a ferro-boron alloy additive containing 1.5 to 2.8% boron by weight which is later added to molten steel to increase strength and hardenability The alloy additive, when mixed with the steel, contains approximately 0.01 to 0.03% boron by weight.

These last two noted patents teach an additive that is employed to make a crystalline ferro-boron alloy. Nevertheless, the additive of U.S. Pat. No. 1,562,042 can be employed to make an amorphous ferro-boron alloy because the additive in briquette form contains 16% boron by weight.

The following U.S. patents teach a process for converting a ferro-boron alloy containing greater than 1.4% boron by weight into an amorphous alloy and are hereby incorporated by reference:

U.S. Pat. Nos. 4,133,679 and 4,255,189 teach a typical amorphous boron alloy composition containing 6–15 atom percent boron and including either molybdenum or tungsten with the remainder being at least one of iron, nickel, cobalt or manganese. These elements are melted together and spun as a molten jet by applying argon gas at a pressure of 5 psi. The molten jet impinges on a rotating surface forming a ribbon which is extracted and further treated.

Other patents disclose the use of boron in ferrous melts for a wide variety of purposes as noted by the following patents:

British Patent No. 1,450,385 and U.S. Pat. No. 3,809,547 disclose the employment of boron compounds which are introduced into a ferrous melt as a fluxing agent for the slag. Neither of these patents discloses recovering boron from the boron compounds for the purpose of alloying the boron with the iron.

U.S. Pat. Nos. 1,027,620 and 1,537,997 disclose the addition of a boron compound to molten iron for the purpose of removing phosphorus, sulfur and nitrogen by chemically reacting boron with these elements found in the iron melt and forming a slag which is removed before pouring. Neither of these references teach recovering the boron from the boron compound such that the boron is capable of alloying with the iron. To the contrary, these references teach chemically reacting the boron to form a slag which is separated from the molten iron. Additionally, '997 teaches reducing the nitrogen content in the melt to less than 0.0015%.

East German Patent No. 148,963 discloses the addition of boron oxide to molten steel in a furnace or ladle to obtain a total boron content of 30 to 160 parts per million. The boron addition acts as a chip breaker and increases machinability of the steel. It is apparent that very little boron is recovered from the boron compound because only a small amount of boron is present in the steel.

None of the above mentioned references teach reducing a boron compound with a reductant in a melt to form a boron alloy.

Although boron oxide is not employed to make stainless steel, the Argon-Oxygen Reactor (AOR) or the Argon-Oxygen Decarburization (AOD) process to make stainless steel does employ a reductant to reduce chromium, iron or manganese oxides back into the steel melt. This improves the recovery of chromium, iron or manganese over the conventional electric furnace process of making stainless steel. The following reference describes the conventional AOR:

"Making Stainless Steel in the Argon-Oxygen Reactor at Joslyn" by J. M. Saccomano et al, published in *Journal of Metals*, Feb. 1969, pages 59–64 disclose a process for refining a ferrous melt containing chromium by introducing an argon-oxygen gas into the melt to decarburize the melt.

In the AOR process for stainless steel, usually about 1–2% by weight of the melt is lost to the slag as oxides during the decarburization step and recovery of elements (chromium, iron, and manganese) from these oxides is very efficient using lime, silicon and sometimes aluminum. Scrap and ferro-alloys containing the metallic elements to make stainless steel are a more cost effective source for these elements than using oxide and reductant additions. However, in the case of ferro-boron, the reduction of the boron compound in a AOR type vessel using a strong reductant is economically favorable. Theoretically, reduction of one pound of boron from boron oxide requires 1.95 lbs of silicon or 2.50 lbs of aluminum. The reduction of boron oxide using silicon as a reductant in a mixing vessel is not immediately obvious because it is a very stable oxide (more stable than chromium oxide and about the same stability as silicon oxide). Also refractory erosion was believed to be a problem when boron oxide would be added to slags at conventional steel making temperatures. Therefore, it has always been the practice of the industry to purchase and employ ferro-boron as an additive to the melt.

Accordingly, the need exists for a process of reducing inexpensive boron compounds to recover boron which can be alloyed with other metals.

SUMMARY OF THE INVENTION

The present invention provides a process designed to supersede the intermediate briquette processing and all other prior art processes. The present invention employs relatively impure forms of boron which are added directly to a metallic melt contained in a refining furnace or mixing vessel. If the melt contains a sufficient amount of strong reductants or deoxidizers (Si, Al, C, alkaline earth metals, group (IV)(B) metals, rare earth metals and mischmetals), and there is sufficient melt and slag mixing, the boron compound will be reduced in situ. The boron then alloys with the melt. The boron compounds, for example, can be at least one of boron trioxide, boric acid, borax, calcium metaborate, colemanite, rasorite, ulexite, inderite, kernite, kurnakovite, probertite, sassolite and lesser known forms of borates or borides.

The boron alloys of the present invention may contain relatively small amounts of boron for hardenability or other characteristics previously disclosed, or increasingly larger percentages of boron which when further treated, produce what is typically known as glass or amorphous metal alloys. The terms glass or amorphous as used herein mean a state of matter in which the component atoms are arranged in a disorderly array; that is, there is no long range order. Such a glass or amorphous alloy material gives rise to broad diffused diffraction peaks when subjected to electromagnetic radiation in the X-ray region. This is in contrast to crystalline material, such as steels, having a lower boron content and slower solidification rate in which the component atoms are arranged in an orderly array giving rise to sharp X-ray diffraction peaks.

Amorphous ferro-boron alloys for electromagnetic uses may contain up to 5% boron with a preferred range from about 2.5% to 4.6% boron, up to 7.0% silicon, and up to about 0.5% carbon, in weight percent, with the balance being essentially iron. A more preferred alloy contains 3.0% boron, 5.0% silicon, about 0.1% carbon, in weight percent, with the balance being residuals and iron.

Non-ferrous amorphous boron alloys containing, for example, nickel, cobalt, silicon, germanium or copper based alloys can be made by the process of the present invention. Amorphous non-ferrous boron alloys which may be used for making razor blades, semiconductors or metal cords in tires range from about 60–70% nickel, about 20–30% boron and 5–20% aluminum, in atomic percent.

The broadest form of the present invention provides a process of producing, in situ, a boron alloy comprising: melting a metallic charge to provide a melt; adding a strong deoxidant to the melt; adding a boron compound to the melt; and mixing the melt, deoxidant, and boron compound vigorously to reduce the boron compound into elemental boron, thus alloying the melt and the elemental boron. The amount of boron compound being added to the melt would depend upon the final desired percentage of boron in the melt. Generally the recovery of boron from the boron compounds, according to the present invention, is greater than 40% by weight, based upon the amount of boron in the compound.

The process of the present invention is designed to be implemented with typical refining equipment such as an induction furnace, an electric furnace, or basic oxygen furnace along with a reaction mixing vessel, or implemented in the furnaces themselves.

BRIEF DESCRIPTION OF THE DRAWING

The drawing is a graphic comparison of the percent boron oxide in a slag, with the percent boron in a ferrous melt after completion of the process of the invention.

DESCRIPTION OF THE PREFERRED EMBODIMENTS

Boron is a common element added to steel to form an alloy containing from about 0.001 to 15% by weight boron. As little as 0.001% boron by weight greatly increases the hardenability of steel making it desirable for tool steel or extra strong wire for cables or fencing. Amorphous ferro-boron alloys contain from about 1.4–15% boron by weight and have potential as substitute materials for electrical silicon steel used in transformers, for example. Amorphous non-ferrous boron alloys can be employed in making semiconductors, cores for magnetic heads, brazing material or razor blades.

The present process can be carried out using existing equipment normally found in a steel mill or foundry, such as a basic oxygen furnace, an induction furnace or electric furnace, an AOR and a conventional ladle.

Generally, a melt is made in a basic oxygen furnace, an induction furnace, an electric furnace, or the like. When the charge is melted, preferably the slag will be skimmed, held back, or poured off for reasons which are subsequently explained.

Although the remaining procedure can be conducted in a furnace equipped with special tuyeres or porous plugs, simple economics dictates the undesirability of employing the furnace for a process that can be conducted in equipment that is less expensive to operate. Consequently, the melt should be duplexed by transferring to a separate vessel for vigorous mixing. Nevertheless, if the melting furnace is employed for the remainder of the process, it is operated just as a mixing vessel with tuyeres or porous plugs, as will be subsequently explained. Another procedure is to decarburize in the mixing vessel, slag off, then start the boron addition practice.

The mixing vessel can be a conventional ladle, a ladle with tuyeres or porous plugs, an AOR or the like.

Once the mixing vessel is charged with the melt which preferably contains substantially no slag, the other components, such as the reductant, boron compound, and slagging agents can be added to the melt independently or simultaneously. The order of adding the other components can be interchangeable without substantially affecting the overall process of the present invention. Nevertheless certain advantages can be gained from adding the other components in a preferred manner.

When the melt is tapped into the mixing vessel, it generally contains silicon. The amount of silicon present in the melt is directly related to the amounts of the components which form the melt as is well known to those skilled in the art. For example, electrical steels are generally formed with a high amount of silicon.

Because the melt contains some silicon, the preferred manner of adding the components calls first for adding the additional amount of reductants necessary to reduce the boron compound. For reasons to be stated later, the preferred reductant comprises $\frac{2}{3}$ Si and $\frac{1}{3}$ Al. Some or all the silicon is present in the melt when tapped, making it necessary to add the aluminum and any additional silicon. Because these reductants cause an exothermic reaction when added to the melt, the addition of the reductant at this stage of the process has certain benefits. Chief among those benefits is the increase in temperature of the melt, and the enhanced mixing due to the decreased viscosity of the melt.

After the reductants have been added, it is generally preferred to add the boron compound or compounds, simultaneously with the slagging agents. The boron compounds may be anhydrous or calcined to prevent uncontrolled steam blowout from the mixing vessel. In any case, it is generally desirable to employ boron compounds which contain no more than 3% water or $CO_2$, by weight, based on the total weight of the compounds.

Commercially available colemanite or boric acid are the preferred boron compounds. Although colemanite concentrate is less expensive than calcined colemanite because the mineral processor can eliminate the final drying step, it may be more practical to use fully calcined colemanite because of steam and $CO_2$ out-gassing and temperature loss during mixing. Also, colemanite contains lime in about the correct amount necessary to neutralize $SiO_2$, thus making it possible to minimize or eliminate the lime addition.

The slagging agents consist primarily of lime - CaO which will neutralize the acidic $SiO_2$. Lime is added to change the activity of the slag components, to promote the thermo-chemical reduction of boron from boron oxide in the slag, and to lower the melting point of the slag. In general, it is desirable to attain at least a 1:1 $CaO:SiO_2$ ratio, after reduction, thereby assuring minimum refractory erosion caused by the $SiO_2$.

In summary, while the order of adding the components is not critical, the preferred procedure is to add the reductant first, and then add the boron compound and the slagging agent.

Once all the components have been added, it is necessary to mix the melt vigorously with the components for a period of about between 5–20 minutes, and preferably about 10 minutes. By "vigorously mixing" it is meant that the metal - slag interface movement is sufficient to result in a dynamic balance between the slag and metal as well as the components and the metal, which results in equilibrium condition being reached between the metal and the slag, as shown in FIG. 1 for an iron melt in which silicon is the principal reductant for boron oxide. Vigorous mixing is characterized by a rolling movement of the melt whereby the melt from the lower portions of the vessel ascends, while melt from the upper portions is drawn downwardly.

Vigorous mixing can be achieved in various ways such as by gas injection, magnetic stirring, mechanical mixing, operator mixing, or the like, or any combination thereof. If the mixing vessel is a ladle, generally the mixing is achieved by inert gas stirring. If the mixing vessel is a small laboratory crucible, an operator can stir the melt with a refractory stirrer. If the mixing vessel is a ladle with tuyeres or porous plugs, or an AOR, mixing may be achieved by injecting a non-oxidizing or inert gas, such as argon gas, into the melt. If there is a capacity problem in the mixing vessel, the slagging agent, boron compound and reductant can be split into two or more separate additions, mixing steps, and slag offs.

Generally, slag chemistry, appearance and color indicate whether or not the process has proceeded to the desired degree of reduction. For example, if adequate components were initially added to the melt but the boron oxide in the slag is extremely high and the appearance and color are not acceptable as is well known to those skilled in the art, then the desired degree of reduction has not been achieved.

Certain components are desired in the slag, such as $Al_2O_3$ which facilitates mixing and lower the melting point. Thus, the slag chemistry should contain about 10–18% $Al_2O_3$.

Where a reductant of $\frac{1}{3}$ Al and $\frac{2}{3}$ Si is employed in a mixing vessel having a magnesium oxide refractory lining, a typical slag should contain 10% to 18% $Al_2O_3$, 25% to 35% CaO, 25% to 35% $SiO_2$, 5% to 15% MgO and 5% to 25% $B_2O_3$. A more typical slag containing 15% $Al_2O_3$, 30% CaO, 30% $SiO_2$, 8% MgO with the balance being substantially $B_2O_3$ has a good slag basicity ratio ($CaO/SiO_2=1$), the proper amount of $Al_2O_3$, and a metal chemistry containing about 2.85% boron.

The drawing illustrates an experimentally determined equilibrium curve between the % boron oxide in the slag and the % boron in a ferrous melt when silicon is the principal reductant and does not exceed 5.3% silicon in the final melt. In order to achieve 3% boron in a melt, the % boron oxide in the slag must be above 18%. As is illustrated, the higher the % boron in the melt, the higher the % of boron oxide in the slag at equilibrium conditions.

Because the reductant reduces less stable oxides in the slag before it reduces the boron oxide (boron oxide is very stable compared to other oxides, including ferrous oxides), it is important to remove substantially all the slag incurred during melting the metal. This will also help to minimize the total slag volume. With a fixed equilibrium boron oxide concentration the amount of boron oxide left in the slag is directly related to the slag volume. Consequently, less boron oxide will be necessary to achieve the final boron content in the melt with no residual furnace slag.

If the slag from the melt, after the final equilibrium is achieved in the mixing vessel, is recycled to a subsequent heat, it can serve as a source for boron. The percent boron oxide level of the slag can be reduced to a lower equilibrium level because of the lower percent boron content of the new heat. As disclosed above, this intermediate slag would preferably be skimmed off before making the final boron compound addition.

The selection of the deoxidant or reductant (C, Al, Si, Ca, Ti, Mg, Zr or a rare earth metal) is very important. The reduction reaction for the most common elements (C, Si, and Al) are shown as:

$$B_2O_3+3C=2B+3CO \quad (1)$$

$$2B_2O_3+3Si=4B+3SiO_2 \quad (2)$$

$$B_2O_3+2Al=2B+Al_2O_3 \quad (3)$$

Carbon is the least expensive reductant and even though reaction is endothermic, it could be used as a reductant. However, because relatively high amounts of energy and a high process temperature for reaction would be needed, it normally would not be employed as the sole reductant. If carbon is used as a reducing agent, oxygen would probably have to be blown into the melt to lower the carbon content if the final carbon aim is $\leqq 0.1\%$ after reduction of the boron oxide is completed. Note that any excess oxygen would oxidize some of the boron just reduced and consequently, carbon is the least desired reductant.

Silicon is the next least expensive reductant (theoretically 1.95 lbs of Si required to reduce 1 lb of boron from the slag), the boron oxide reduction reaction (2) is thermodynamically more favorable at lower temperatures, and the reaction is exothermic. However, reaction (2) adds an acid component ($SiO_2$) to the slag which requires lime (CaO) to neutralize it. Also, too much silica in the slag slows down reaction (2) because the thermodynamic activity of $SiO_2$ in the slag is increased, thus driving the reaction to the left which retards the reduction of $B_2O_3$.

Because aluminum is the most expensive (theoretically 2.5 lbs of Al is required to reduce 1 lb of boron from the slag) of the three most common reductants, it is generally not employed as the sole reductant. Yet, aluminum has characteristics which are favorable to the overall process. First, the boron oxide reduction reaction (3) is exothermic like reaction (2), and second, it does not attack most refractory linings in furnaces, AOR and ladles, and third, it is the strongest reductant of the three common reductants.

The preferred reductant comprises $\frac{2}{3}$ Si and $\frac{1}{3}$ Al because a reductant comprising all aluminum is too expensive and results in too great a final aluminum content for amorphous electrical melts, while a reductant comprising all Si forms additional $SiO_2$ in the slag which must be neutralized by additional lime to prevent refractory erosion. Also, too much silica in the slag retards the reduction of $B_2O_3$ as previously explained.

In forming a ferrous amorphous alloy, it is well known that aluminum present in the alloy should be as low as possible, preferably less than 0.010% by weight, because aluminum causes nozzle plugging and a crystalline phase formation during strip casting. Therefore, adding aluminum to the melt would cause a higher content of aluminum in the alloy, according to conventional thinking. However, when aluminum reduces the $B_2O_3$, $Al_2O_3$ is formed and becomes part of the slag. $Al_2O_3$ in the slag is desirable because it fluidizes the slag, thus helping to achieve a metal/slag equilibrium. The preferred slag contains about 15% $Al_2O_3$, which can be substantially achieved by employing about $\frac{1}{3}$ of the reductant as aluminum to recover approximately $\frac{1}{3}$ of the boron. Consequently, the preferred reductant is approximately $\frac{1}{3}$ Al and $\frac{2}{3}$ Si.

The amount of deoxidizer or reductant can easily be determined by mass balance. For example, when using boron oxide as the boron compound and aluminum as the deoxidizer, $B_2O_3+2\ Al \rightarrow Al_2O_3+2B$, twice the molar amount of aluminum is necessary to theoretically reduce each mole of boron oxide to boron. Thus, by knowing the amount of boron oxide that is necessary to yield a specific amount of boron in an alloy, the amount of reductant can be calculated by mass balance.

In order to form an amorphous material, the ferroboron alloys containing greater than 1.4% by weight boron or the non-ferrous boron alloys are deposited, in a molten metal phase, onto a moving chill body surface. Depositing the molten metal onto the surface of the chill body is usually accomplished by forcing the molten metal through a nozzle located adjacent the surface of the chill body. A thin strip of molten metal is instantly formed and solidified into an amorphous metal strip.

A strip is a slender body whose thickness is very small compared to its length and width, and includes such bodies as sheets, filaments, or ribbons as is known in the prior art.

The critical physical parameters for forming an amorphous strip are the size of the orifice of the nozzle, the velocity of the chill body surface and the quenching rate of the molten metal.

Generally the orifice of the nozzle is slit-like or oblong with the length of the orifice forming the width of the amorphous strip, that is, the length of the orifice is adjacent to and parallel with the width of the chill surface. In general, there is no limitation on the length of the orifice, but the width is from about 0.3 to about 2 millimeters.

Typically the chill body is a rotating wheel on the outer surface of which the molten metal is deposited. Although any moving chill body will suffice, it is the velocity of the deposition surface that is of critical importance. Conventionally, the chill surface must have a velocity in the range from about 100 to about 2000 meters per minute.

Lastly, the chill body must be cold enough to quench the molten metal at a rate of at least about $10^4$ °C./sec. to form an amorphous solid strip. The quench rate must be very rapid to prevent the metal from arranging itself in a crystalline form as normally occurs with a slower solidification rate.

Experimental Procedure

All percentages are weight percent based on the total melt weight. The iron and ferro-silicon were melted in a 1000 lb capacity air induction furnace. The ferrous melt was tapped at high temperatures through a tundish into a 1000 lb capacity refractory lined mixing vessel which had been equipped with a single commercial porous plug in the bottom, for injecting the argon gas. The heats were tapped as hot as possible to overcome the relatively high thermal losses, partially due to the small heat sizes. The slagging agents and boron compound were premixed and some premelted separately in a graphite lined induction furnace. Part of the reductant was contained in the initial melt and part added to the mixing vessel. On some heats, premelted slagging agents were added to the mixing vessel during vessel preheating to make the slagging agents as hot as possible before introducing the melt. The balance of the premixed slagging material and the reductants were added to the mixing vessel after tapping the melt. The slag/metal components were mixed thoroughly to promote reduction of the $B_2O_3$ and to control the final tap temperature. The liquidus temperature of the 5% Si - 3% B melt was determined to be approximately 2100° F. The aim for the initial melt silicon on each heat was 3–6%. On the first two heats, enough boron containing slag was added to aim theoretically for 1% boron in the bath. On the third heat, a boron containing ingot was remelted and then a slag addition was made to increase the melt to 2% boron. On the fourth heat, oxygen was added through the porous plug to determine its effect on the final metal chemistry. The ingot from the third heat was remelted as the starting metal for the fifth heat and the boron was increased, using this process, to 3%. Reference is made to Tables 1 and 2 in the following review of each heat.

It should be noted that the chemistry of the melt was not available while the heats were being made, thus "best guess" was sometimes used in deciding what to do during the making of the heat (i.e. bubbling time, additional material, etc.).

Heat 1

90 lbs of premelted components with 50% CaO, 25% $SiO_2$, 25% $B_2O_3$ were added to a 900 lb ferrous melt containing about 6% Si and bubbled with argon in the 1000 lb mixing vessel. Final metal analysis contained 4.6% Si and 0.25% B with the remainder being essentially iron. The melt was cast into a mold forming a crystalline ingot. The bubble time was short because the vessel did not have a good preheat and the premixed components were not preheated before adding to the vessel. The slag analysis indicated some reduction of the $B_2O_3$ (23%→10% $B_2O_3$) and the final slag was acidic, $CaO/SiO_2=0.76$ due to incomplete reaction.

Some coke was added to the vessel before tap to lower the liquidus of the final melt, but due to the rapid temperature drop a heavy skull formed in the vessel. Tap temperature was about 2480° F.

Heat 2

On this heat, 83 lbs of components (43% CaO, 43% $B_2O_3$, 10% $Al_2O_3$ and 5% $CaF_2$), richer in $B_2O_3$ and containing no $SiO_2$ as compared to Heat 1, were added to a 900 lb ferrous melt with 6% silicon and bubbled with argon. The slag basicity and $Al_2O_3$ level were increased to improve boron oxide reduction. The slag components had been premelted and poured into a steel can which was then preheated before adding to the vessel. The vessel had a much better refractory preheat and the temperature drop during bubbling was greatly reduced. See Table 1. Temperature loss was 10°–20° F./min which was typical of previous bubbling experiments in this small vessel. Final metal analysis was 4.2% Si and 0.66% B with the remainder being essentially iron for a boron recovery of 57%. The melt was cast into a mold forming a crystalline ingot. The final slag basicity was 0.94 and contained 7.6% $B_2O_3$.

Heat 3

Referring to Tables 1 and 2 the ingot from Heat 2 (760 lbs) was remelted with additional iron and ferro-silicon in the 1000 lb induction furnace and yielded metal chemistry of 6.8% Si and 0.55% B. Double the quantity of the same oxide components (compared to Heat 2) were premixed into a steel can and preheated before adding to the mixing vessel. The final metal chemistry was 4.1% Si and 1.73% B with the balance being essentially iron for a boron recovery of 53%. This metal chemistry is suitable for making amorphous materials upon further processing. Final slag chemistry was 40% CaO, 31% $SiO_2$, 7% $Al_2O_3$ and 15% $B_2O_3$. Reduction of this larger quantity of slag was not as efficient as Heat 2, which could have been the result of a larger slag volume, the higher boron level in the metal, and/or the lower alumina level. Temperature drop during reduction was typical and the heat was poured into a mold at 2470° F. with no problems. This alloy could be further treated, including chill casting, to form an amorphous material.

Heat 4

This heat was made immediately following Heat 3 while the vessel was hot. The component materials consisted of lime and alumina added to the hot vessel 20 minutes before tap of the induction furnace, and the boron oxide and spar were added after tapping metal into the mixing vessel. The metal chemistry after this reduction step contained 4.1% Si and 0.82% B with the remainder being essentially iron for a boron recovery of 75%. Slag chemistry was 37% CaO, 34% $SiO_2$, 9% $Al_2O_3$, 15% MgO and 9% $B_2O_3$, and with a slag basicity of 1.1. After reduction, oxygen was bubbled for 10 minutes to determine the boron and silicon losses during oxygen blowing. Metal analysis indicated a boron drop from 0.82% to 0.7% because some of the boron combined with oxygen to form additional $B_2O_3$ in the slag. The final slag had a composition of 32% CaO, 36% $SiO_2$, 9.0% $Al_2O_3$, 19% MgO and 9% $B_2O_3$. A large increase in MgO indicates refractory attack.

The purpose of the following additional laboratory heats was to determine if a 3% by weight B content melt can be obtained from the melt of a prior heat.

Heat 5

The ingot from Heat 3 (1.73% B) was remelted with additional iron and ferro-silicon to a melt chemistry shown at 0 minutes in Table 1. The 900 lb heat was tapped at 3050° F. into the preheated mixing vessel which already contained lime, alumina, boron oxide, and spar (see Table 2). The slag and metal were stirred by argon injection for 22 minutes; metal and slag chemistries and bath temperatures are shown in Table 1.

Results indicate that the $B_2O_3$ reduction reaction with silicon was complete in about 12 minutes. The boron level of the melt increased from 1.4% to 2.7% at a silicon content of 5.0%.

After 15 minutes of mixing, 4 lbs of aluminum (0.4%) was added to the molten slag/metal bath and stirred for another 8 minutes. From the data in Table 1 it can be seen that after the aluminum addition, the B and Si contents of the metal bath increased, from 2.73% to 2.85% and from 4.97% to 5.11%, respectively. The final metal chemistry was 2.80% boron, 5.13% silicon with the remainder being essentially iron. This chemistry, upon further processing is capable of forming an amorphous alloy for electrical applications. The slag $Al_2O_3$ content increased slightly while the $B_2O_3$ and $SiO_2$ level in the slag dropped. Due to the exothermic aluminum reduction reaction, the bath temperature did not continue to fall at the normal rate (20°/min), but actually increased 20° F. after the Al addition.

After making this heat, it was concluded that the 3% B level can be reached at least by using three reduction steps (Heats 2, 3, 5). It was decided to attempt to use a single step to achieve the 3%B level in the next heat.

Heat 6

This heat was also a 900 lb heat with about half the total silicon added in the furnace as ferro-silicon and the balance added as pure silicon (73 lbs) during slag reduction. Silicon metal was used to compensate for the high heat losses in the small mixing vessel. The component materials are shown in Table 2. Eighty lb of lime plus all the alumina and spar were added to the vessel during the vessel preheat cycle (see Table 2). Then the heat was tapped at 3080° F. into the vessel with the preheated component materials.

During bubbling, the boron oxide and the balance of the lime were added. None of these final materials had been premelted or premixed. After all additions were in, it was obvious that too much component materials and metal had been added because the slag was up to the top of the vessel mouth. There was extremely poor mixing and the metal and slag chemistries (Table 1) both indicate a very poor boron recovery. The slag was cold, viscous, and not mixing well with the metal. An equivalent 5% boron had been added as boron oxide and the final boron level was only 0.36%. The high silicon melt did not reduce the boron oxide containing slag. The final melt contained a high amount of silicon (9%) and the slag had a low amount of silica due to inadequate slag/metal mixing. This alloy is incapable of forming an amorphous alloy because of the low final percent boron.

This experiment illustrates the necessity and criticality of vigorous mixing. All the components necessary to make a composition capable of forming the desired chemistry were in the melt. However, because of the lack of vigorous mixing, very little boron was recovered into the melt, yielding a final metal containing only 0.36% boron, by weight. It further points out that the majority of slag forming components should not be added to the mixing vessel prior to adding the melt because: (1) slag formation is greatly enhanced by adding the slagging agents to the melt; (2) as the slagging agents melt, they may react with the refractory in the bottom of the mixing vessel. On the next heat aluminum was used to reduce ⅓ of the $B_2O_3$ and to generate the proper alumina content for the slag. This should reduce the oxide addition by 50% by requiring less lime and no alumina addition to the slag. Aluminum was added early at higher $B_2O_3$ levels to achieve a lower final residual Al content.

Heat 7

In this heat, the premixed preheated components in the vessel had no alumina or spar(see Table 2). Heat size was also reduced to 560 lbs to reduce the volume problems encountered in previous heats. Aluminum (15 lbs) and silicon (25 lbs) were added to the vessel after tapping from the furnace. As can be seen in Table 1, the Al and Si did supply $Al_2O_3$ (17%) and $SiO_2$ (29%) to the slag while reducing the $B_2O_3$ level from 61% to 18% (at 20 minutes). The basicity ($CaO/SiO_2$) of the slag was 1.0. At 20 minutes the metallic boron level was 2.96% with 4.8% Si.

Following the reduction step, the slag/metal was too hot to tap and it was decided to add additional anhydrous boric acid (38 lbs of $B_2O_3$). No additional lime, silicon, or aluminum was added with this late boron oxide material. The metallic boron level increased from 2.96% up to 3.50% and the silicon level dropped from 4.8% down to 3.5%. Slag chemistry data (Table 1) also indicated a higher $B_2O_3$ level and also the slag had become more acid due to the increased $SiO_2$ from the reduction reaction.

The sulfur content of the heat was built to 0.039% in the induction furnace and after 32 minutes of mixing in the mixing vessel it was 0.0006%. The nitrogen finished very low at <0.0005%. After 20 minutes mixing the boron level was 2.96% for a boron recovery of 59%. This alloy could be further treated to form amorphous material.

The next heat was made to illustrate the employment of calcined colemanite as the primary boron compound.

Heat 8.

Calcined colemanite was the major source of $B_2O_3$ for this heat. Commercially available calcined colemanite had been further calcined at 1600° F. to drive off the residual $CO_2$. As a consequence of this added step, the density of the calcined colemanite was very low. This heat did not employ the premixing and preheating step employed in other heats. It took 9 minutes to add all the slag components (slagging agents, boron compound and reductant). Additions to the vessel were complete in 2 minutes on previous heats. The reductant included 34 lbs of silicon and 19 lbs of aluminum. To achieve the proper boron oxide addition 26 lbs of $B_2O_3$ were also added. The heat was tapped shortly after all the other components were added (15 min) because the temperature had dropped to 2170° F., which is close to the liquidus temperature of 2100° F. The metal analysis indicated a high percent of Si, and slag chemical analysis yielded a high percent of $B_2O_3$ and a low percent $SiO_2$. This again indicates the importance of sufficient mixing to achieve metal/slag equilibrium, i.e., 3% boron and 5% silicon in the melt and 18% $B_2O_3$ in the slag. Boron recovery for this short mixing time was only 43%.

The next heat was designed to illustrate the employment of a high boron oxide containing slag from a previous melt to supply boron to a new melt.

Heat 9.

This was a 50 lb laboratory size silicon steel melt in which a slag from one of the previous 1000 lbs melt was the source of boron. The initial metal chemistry was 0.056% carbon, 0.02% S, 3.08% Si, less than 0.001% B with the remainder being iron. The slag initially contained: 31.4% CaO, 30.3% $SiO_2$, 5.0% MgO, 15.9% $Al_2O_3$, 0.5% FeO, 19.9% $B_2O_3$. Some of this slag was added to the bath and mechanically mixed with a metal rod. The final metal chemistry was 0.057% carbon, 0.025% S, 2.40% Si, and 0.29% boron. The slag which remained (that which was not lost) had a chemistry of 27.9% CaO, 37.8% $SiO_2$, 8.4% MgO, 15.2% $Al_2O_3$, 1.0% FeO, and 0.2% $B_2O_3$. Note that the initial slag had 19.9% $B_2O_3$ while the slag which was not lost had 0.2% $B_2O_3$. Also note that the initial metal chemistry had 0.001% B and the final metal chemistry had 0.29% B. These two details indicate that slag from a previous melt can be employed as a boron source for a subsequent melt. The change in slag or melt chemistry could not be used to calculate the recovery of boron because of the slag losses to the induction furnace crucible and to the metal stirring rod.

Heat 10.

This experiment illustrated the ability to make a non-ferrous boron alloy by the same single step boron reduction procedure. A 50 lb nickel base metallic charge with following analysis:

| C | S | Ni | Fe | Si | Al | B |
|---|---|---|---|---|---|---|
| .010 | <.0005 | 84.2 | .6 | 4.97 | .070 | <.05 |

was melted and other components including a premelted slag (Table 1) were added with extra silicon and aluminum and mechanically stirred for reduction of the boron oxide. The final metal chemistry was 79.3% Ni, 5.5% Fe, 7.8% Si, and 1.39% B. Slag chemistry indicated a residual $B_2O_3$ of 37.8%. These analyses indicate that about 30–40% of the $B_2O_3$ was reduced from the slag. As with Heat 9, some of the slag reacted with the MgO crucible and this lowered the boron recovery values.

From the various examples, it will be evident that some critical factors in the procedure of the present invention are important to produce the desired product, such as proper heat size relative to the mixing vessel size, very good mixing, careful temperature control and proper additions of the alloys and slagging agents. It is preferred to provide a non-oxidizing atmosphere above the melt during mixing, although a slag cover of sufficient volume may provide adequate protection against oxidation by air.

With regard to careful temperature control, preheating the components greatly decreases the temperature drop during the boron oxide reduction. Also, preheating the slag greatly improves the rate of dissolving the slag into the melt. Both are particularly important when operating on a small scale. However, it is probably not necessary to premix or premelt the slag components on a commercial scale, i.e., greater than 25 tons. Temperature can be partially controlled by proper selection of the reduction materials.

TABLE 1

| Heat | Bubble | Temp | Metal Analysis % | | | | | Slag Analysis % | | | | | | |
|---|---|---|---|---|---|---|---|---|---|---|---|---|---|---|
| No. | Time(min) | °F. | C | S | Si | B | N | CaO | $SiO_2$ | MgO | $Al_2O_3$ | $CaF_2$ | FeO | $B_2O_3$ |
| 1 | 0 | 2700* | .13 | .008 | 5.79 | <.01 | N/A | 47.3 | 27.6 | N/A | N/A | N/A | N/A | 22.7 |
| | 5:0 | 2488 | 1.53 | .034 | 4.61 | .25 | N/A | 30.0 | 39.7 | 2.2 | 8.1*** | N/A | N/A | 9.94 |
| 2 | 0 | 2800* | .10 | .008 | 5.75 | <.01 | N/A | 46.9 | 1.9 | 1.1 | 10.6 | 5** | N/A | 40.7 |
| | 2:15 | 2700 | .11 | .007 | 4.48 | .62 | N/A | N/A | N/A | N/A | N/A | N/A | N/A | N/A |
| | 4:30 | 2700 | .095 | .006 | 3.73 | .66 | N/A | N/A | N/A | N/A | N/A | N/A | N/A | N/A |
| | 10:00 | 2650 | .10 | .005 | 4.18 | .66 | N/A | 34.4 | 36.6 | 11.3 | 12.2 | N/A | N/A | 7.6 |
| 3 | 0 | 2700* | .98 | .006 | 6.83 | .55 | N/A | 44.5 | .9 | .9 | 5.6 | 4.7** | N/A | 41.7 |
| | 1:15 | 2650 | N/A | N/A | N/A | 1.32 | N/A | N/A | N/A | N/A | N/A | N/A | N/A | N/A |
| | 1:55 | 2620 | N/A | N/A | N/A | 1.57 | N/A | N/A | N/A | N/A | N/A | N/A | N/A | 16.0 |
| | 4:00 | 2560 | .10 | .0026 | 4.25 | 1.75 | N/A | N/A | N/A | N/A | N/A | N/A | N/A | 14.0 |
| | 8:00 | 2510 | .11 | .0021 | 4.12 | 1.73 | N/A | 39.7 | 30.7 | 8.9 | 6.7 | N/A | N/A | 14.6 |
| | 12:30 | 2480 | N/A | N/A | N/A | N/A | N/A | N/A | N/A | N/A | N/A | N/A | N/A | N/A |
| 4 | 0 | 2800* | .11 | .006 | 5.68 | <.01 | N/A | 46** | 1** | 1** | 8.6** | | 5.2** | N/A 40.2* |
| | 2:30 | 2750 | N/A | N/A | N/A | .69 | N/A | N/A | N/A | N/A | N/A | N/A | N/A | 9.1 |
| | 5:00 | 2700 | N/A | N/A | N/A | .82 | N/A | 36.7 | 34.3 | 14.7 | 8.9 | N/A | N/A | 9.0 |
| | 9:50 | 2620 | .10 | .0031 | 4.08 | .82 | N/A | N/A | N/A | N/A | N/A | N/A | N/A | 8.9 |
| | $O_2$ blow | 2650 | .10 | N/A | N/A | N/A | N/A | N/A | N/A | N/A | N/A | N/A | N/A | N/A |
| | 23:00 | 2630 | .10 | .0030 | 3.61 | .71 | N/A | 31.8 | 35.5 | 18.7 | 8.9 | N/A | N/A | 9.2 |
| 5 | 0 | 2800* | .10 | .0019 | 8.19 | 1.40 | N/A | N/A | N/A | N/A | N/A | N/A | N/A | N/A |
| | 3:20 | 2600 | N/A | N/A | 6.63 | 2.01 | N/A | N/A | N/A | N/A | N/A | N/A | N/A | N/A |
| | 5:40 | 2500 | N/A | N/A | N/A | 2.69 | N/A | N/A | N/A | N/A | N/A | N/A | N/A | 22.3 |
| | 12:15 | 2400 | N/A | N/A | 4.97 | 2.73 | N/A | 38.8 | 29.1 | 8.1 | 9.0 | N/A | .5 | 17.3 |
| | 15:40 | 2420 | N/A | N/A | 5.11 | 2.85 | N/A | N/A | N/A | N/A | N/A | N/A | N/A | N/A |
| | 16:50 | 2400 | N/A | N/A | N/A | 2.81 | N/A | 39.0 | 27.4 | 8.7 | 12.5 | N/A | .5 | 16.0 |
| | 21:00 | 2350 | N/A | N/A | N/A | 2.81 | N/A | 38.5 | 27.0 | 9.6 | 12.9 | N/A | .5 | 15.8 |
| | 21:45 | 2330 | .10 | <.0005 | 5.13 | 2.80 | N/A | N/A | N/A | N/A | N/A | N/A | N/A | N/A |
| 6 | 0 | 2900* | .10 | .0082 | 3.43 | N/A | N/A | N/A | N/A | N/A | N/A | N/A | N/A | N/A |
| | 17:50 | 2700 | .095 | .0021 | 8.89 | .34 | N/A | 30.8 | 12.0 | 4.0 | 7.2 | N/A | .8 | 41.9 |
| | 25:00 | 2580 | .088 | .0019 | 8.91 | .26 | .0022 | 31.1 | 11.8 | 4.0 | 7.3 | N/A | 1.0 | 40.8 |
| | 45:00 | 2355 | .089 | .0018 | 9.08 | .36 | .0119 | 30.6 | 10.6 | 3.9 | 5.8 | N/A | .8 | 43.4 |
| 7 | 0 | 2900* | .16 | .039 | 5.3 | N/A | .0037 | 33.7 | .7 | .5 | <.1 | N/A | .1 | 61.3 |
| | 4:11 | 2580 | .21 | .010 | 6.7 | 2.11 | .0043 | 31.7 | 20.0 | 4.9 | 16.4 | N/A | 1.5 | 28.8 |
| | 6:00 | 2560 | .17 | .0085 | 6.1 | 2.49 | .0005 | 29.7 | 23.7 | 5.4 | 16.6 | N/A | 1.5 | 23.8 |
| | 20:00 | 2440 | .18 | .0049 | 4.8 | 2.96 | <.0005 | 28.2 | 29.3 | 8.1 | 17.3 | N/A | 1.3 | 18.2 |
| | 32:30 | 2320 | .18 | .0006 | 4.1 | 3.34 | −.0005 | 25.2 | 31.0 | 7.9 | 15.5 | N/A | .9 | 21.0 |
| | 39:00 | 2275 | .19 | .0073 | 3.5 | 3.50 | <.0005 | 23.8 | 30.9 | 7.8 | 14.2 | N/A | .6 | 25.2 |
| 8 | 0 | 2800* | .097 | .050 | 4.93 | N/A | .0041 | 38.4 | 1.5 | 1.0 | .3 | N/A | .1 | 49.8 |
| | 12:30 | 2170 | .10 | .007 | 8.01 | 2.25 | <.0005 | 34.3 | 15.3 | 3.5 | 15.4 | N/A | .3 | 31.4 |
| | 15:00 | 2180 | .11 | .007 | 7.34 | 2.58 | .0006 | 34.1 | 18.6 | 3.6 | 15.4 | N/A | .3 | 28.5 |
| 9 | 0 | 2890* | .056 | .02 | 3.08 | <.001 | .0033 | 31.4 | 30.3 | 5.0 | 15.9 | N/A | .5 | 19.9 |
| | 22:00 | 2770 | .057 | .025 | 2.40 | .29 | .0034 | 27.9 | 37.8 | 8.4 | 15.2 | N/A | 1.0 | .2 |
| 10 | 0 | 2600* | .010 | <.0005 | 4.97 | <.05 | N/A | 36.8 | .4 | .7 | <.1 | N/A | .1 | 61.1 |
| | 23:00 | 2490 | .053 | <.0005 | 7.84 | 1.39 | N/A | 33.0 | 9.4 | 9.1 | 13.3 | N/A | .5 | 37.8 |

N/A not analyzed

*estimated start melt temperature

**estimate of slag chemistry

***result of aluminia patching material in furnace lining

TABLE 2

| Heat No. | Heat Wt. lbs. | | Slagging Agents - lbs CaO | $SiO_2$ | $Al_2O_3$ | $CaF_2$ | $B_2O_3$ | Reductant | % B Recovery |
|---|---|---|---|---|---|---|---|---|---|
| 1 | 900 | | 42.6 | 24.8 | 0 | 0 | 20.4 | Si | 35.5 |
| 2 | 900 | | 36.0 | 0 | 7.5 | 4.2 | 33.7 | Si | 56.9 |
| 3 | 900 | | 79.0 | 0 | 7.4 | 7.4 | 65.4 | Si | 52.8 |
| 4 | 985 | | 40.0 | 0 | 7.5 | 4.5 | 35.0 | Si | 74.5 |
| 5 | 900 | | 92.0 | 0 | 18 | 10 | 80.0 | Si + Al | 49.9 |
| 6 | 900 | | 130.0 | 0 | 52 | 24 | 175.0 | Si | 6.2** |
| 7 | 600 | premelt | 40.0 | 0 | 0 | 0 | 61 | | |
| | | premix | 18.0 | 0 | 0 | 0 | 33 | Si + Al | 59.0 |
| | | late add'n | 0 | 0 | 0 | 0 | 38 | | |
| 8 | 600 | colemanite | 73.0 | 0 | 0 | 0 | 95 | Si + Al | 42.6 |
| | | Extra $B_2O_3$ | 0 | 0 | 0 | 0 | 26 | | |
| 9 | 50 | | 2.8*** | 2.7*** | 1.4*** | 0 | 1.8 | Si + Al | — |
| 10 | 50 | | 3.5 | 0 | 0 | 0 | 5.2 | Si + Al | 30–40** |

**estimated
***amount in recycled slag

What we claim is:

1. A ferro-boron alloy produced in situ in a basic oxygen furnace, an induction furnace, or an electric furnace, or in combination with a mixing vessel, comprising:
   1.4% to 15% by weight boron;
   less than 0.002% by weight nitrogen;
   less than about 0.2% by weight carbon;
   less than about 0.01% by weight aluminum; and the balance iron with minute amounts of residuals.

2. A nickel-boron alloy produced in situ in a basic oxygen furnace, an induction furnace, or an electric furnace, or in combination with a mixing vessel, comprising:
   at least 0.01% to 15% by weight boron;
   less than 0.002% by weight nitrogen;
   less than about 0.2% by weight carbon;
   less than about 0.01% by weight aluminum; and the balance nickel with minute amounts of residuals.

3. The alloy of claim 1, wherein said boron is 1.4 to 5% by weight.

4. A ferro-boron alloy for electromagnetic uses produced in situ in a basic oxygen furnace, or an induction furnace, an electric furnace, or in combination with a mixing vessel, comprising:
   1.4% to 5% by weight boron;
   1% to 10% by weight silicon;
   less than 0.002% by weight nitrogen;
   less than about 0.2% by weight carbon;
   less than about 0.01% by weight aluminum; and the balance essentially iron with small amounts of residuals.

5. The alloy of claim 4, wherein said boron is 2.5% to 4.6% by weight.

6. The alloy of claim 5, wherein said silicon is no more than 7% by weight.

7. The alloy of claim 4, wherein said alloy contains about 3% boron by weight and about 5% silicon by weight.

8. A nickel-boron alloy produced in situ in a basic oxygen furnace, an induction furnace, or an electric furnace, or in combination with a mixing vessel, comprising:
   at least 1% by weight boron;
   less than 0.002% by weight nitrogen;
   about 1% to 10% by weight silicon;
   less than about 0.2% by weight carbon;
   less than about 0.01% by weight aluminum; and the balance essentially nickel with small amounts of residuals.

9. The alloy as claimed in claim 8, wherein said silicon is 5% to 8% by weight.

10. A ferro-boron alloy produced in situ in a basic oxygen furnace, an induction furnace, or an electric furnace, or in combination with a mixing vessel, consisting essentially of:
   1.4% to 15% by weight boron;
   less than 0.002% by weight nitrogen;
   less than about 0.2% by weight carbon;
   less than about 0.01% to 15% by weight aluminum;
   1% to 10% by weight silicon; and the balance iron with minute amounts of residuals.

11. A nickel-boron alloy produced in situ in a basic oxygen furnace, an induction furnace, or an electric furnace, or in combination with a mixing vessel, consisting essentially of:
   at least 0.01% by weight boron;
   less than 0.002% by weight nitrogen;
   less than about 0.2% by weight carbon;
   less than about 0.01% by weight aluminum;
   1% to 10% by weight silicon; and
   the balance nickel with minute amounts of residuals.

* * * * *